US005542869A

United States Patent [19]

Petty

[11] Patent Number: 5,542,869

[45] Date of Patent: Aug. 6, 1996

[54] BUBBLE BLOWING APPARATUS

[76] Inventor: Frank L. Petty, 3821 A Prescott Rd., Modesto, Calif. 95356

[21] Appl. No.: 366,453

[22] Filed: Dec. 30, 1994

[51] Int. Cl.[6] ..... A63H 33/28

[52] U.S. Cl. ..... 446/016

[58] Field of Search ..... 446/16, 15, 217, 446/218; D21/61, 93

[56] References Cited

U.S. PATENT DOCUMENTS

| | | | |
|---|---|---|---|
| D. 185,805 | 8/1959 | Clark | 446/16 X |
| 1,580,601 | 4/1926 | Hugill | 446/218 |
| 2,862,320 | 12/1958 | Mayo | 446/16 X |
| 3,008,263 | 11/1961 | Ellman | 446/15 |
| 5,078,636 | 1/1972 | Clarke et al. | 446/15 |
| 5,269,715 | 12/1993 | Silveria et al. | 446/16 |
| 5,297,979 | 3/1994 | Amron | 446/16 |

FOREIGN PATENT DOCUMENTS

| | | | |
|---|---|---|---|
| 713773 | 7/1965 | Canada | 446/217 |

*Primary Examiner*—Mickey Yu

[57] ABSTRACT

A bubble blowing apparatus for the automatic, self-generation of bubbles in moving air such as a wind or breeze. Such movement of ambient air causes a fan assembly to rotate which, in turn, imparts rotational movement to a bubble-wand assembly. The relationship between the fan assembly and bubble-wand assembly is such that the energy taken out of the moving air by the fan assembly improves the bubble formation characteristics of the bubble-wand assembly.

5 Claims, 3 Drawing Sheets

BUBBLE BLOWING APPARATUS

RELATED APPLICATIONS

This application is related to applicant's design patent application Ser. No. 29/023,989 filed on Jun. 6, 1994 entitled Turbo-Prop Bubble Generator.

BACKGROUND OF INVENTION

1. Field of Invention

The invention relates to an apparatus for automatically blowing bubbles in the wind.

2. Description of the Related Art

Soap bubbles have fascinated both old and young alike for centuries. Their iridescent quality and myriad shapes delight and entertain. In recent years soap solutions are readily available that are specifically designed for bubble creation and a wide variety of devices have been developed to enhance this pleasurable pastime. Many bubble solutions on the market include with the purchase a simple wand comprised of an arm and a circular opening or ring on one end which one can wave or blow through to produce bubbles. There are a number of comparatively sophisticated devices that have been developed for enhancing one aspect or another of this art form.

An example of a bubble generation device is that set forth in U.S. Pat. No. 5,078,636 where a toy glider is thrown through the air to cause it to emit one or more streams of bubbles simulating jet engine exhaust. In order to maintain a steady stream of bubbles, this device is provided with a bubble-solution reservoir located above the top of the ring to keep it from becoming dry of solution during flight.

A bubble making device is also shown in U.S. Pat. No. 5,297,979 wherein a turbine is caused to rotate by the flow of water under pressure from a garden hose and the motive force of the turbine is used to drive an air blower to generate bubbles from forced air-flow through rings contained in a rotating wheel.

Another apparatus for generating bubbles is disclosed in U.S. Pat. No. 5,269,715 that provides for bubble generation by means of motive force provided by a hand crank which produces a mixture of air, water and bubble mixture so as to produce bubbles.

The present invention does not require the motivating force of a turbine, being thrown or cranked to cause the formation of bubbles; its motivating force is that provided by breezes and light winds as described below.

SUMMARY OF THE INVENTION

This invention generates bubbles in a garden or other home setting where the bubbles are generated on a random basis, much like wind chimes, based on the vagaries of the passing breezes. Like wind-chimes it can be suspended from an overhead structure which is open to the wind, and by means of a rudder it will face into the wind to generate a continuing array of bubbles as long a there is solution in its reservoir. A bubble wheel of numerous wands rotates so as to drip excess solution before the wind is able to exert its full pressure to the soap film. The bubble wheel is cause to rotate by means of a small windmill which is positioned, as described below, so as to enhance its bubble producing qualities.

The device can also be provided with a stand so that it is supported from below rather than being suspended when the preferred location for its use has no overhead structures.

DESCRIPTION OF PREFERRED EMBODIMENTS

Figure 1:
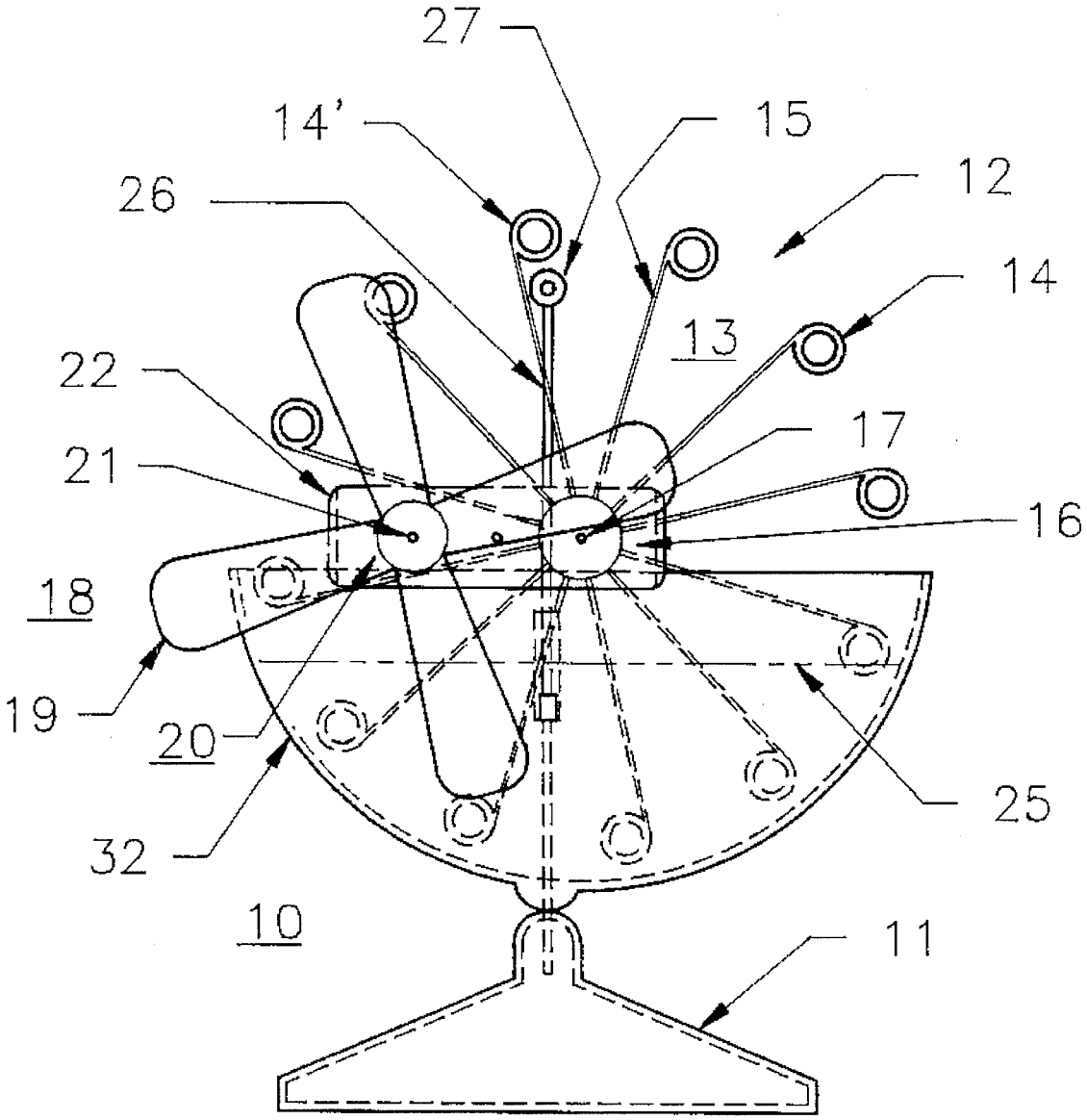
FIG. 1 is a front view of the bubble blowing apparatus of the present invention.

In FIG. 1 the device of the present invention 10 is shown supported on stand 11. The wand assembly 12 is comprised of a plurality of individual wands 13 having rings 14 on one end of arms 15. The arms 15 extend radially from a hub 16 which rotates about a first axle 17.

A fan assembly 18 is comprised of a plurality of blades 19 which extend radially from a hub 20 which is connected to a second axle 21. Interconnecting the fan assembly 18 to the wand assembly is means 22 for transferring the rotational energy of fan assembly 18 to the wand assembly 12. A gear box with a rotation reduction of approximately 50 to one would be an example of a suitable means 22 for interconnection assemblies 18 and 12. In a breeze the fan would be caused to rotate and through gear box 22 the wand assembly 12 would be rotated once for approximately every 50 rotations of the fan assembly 18.

Figure 2:
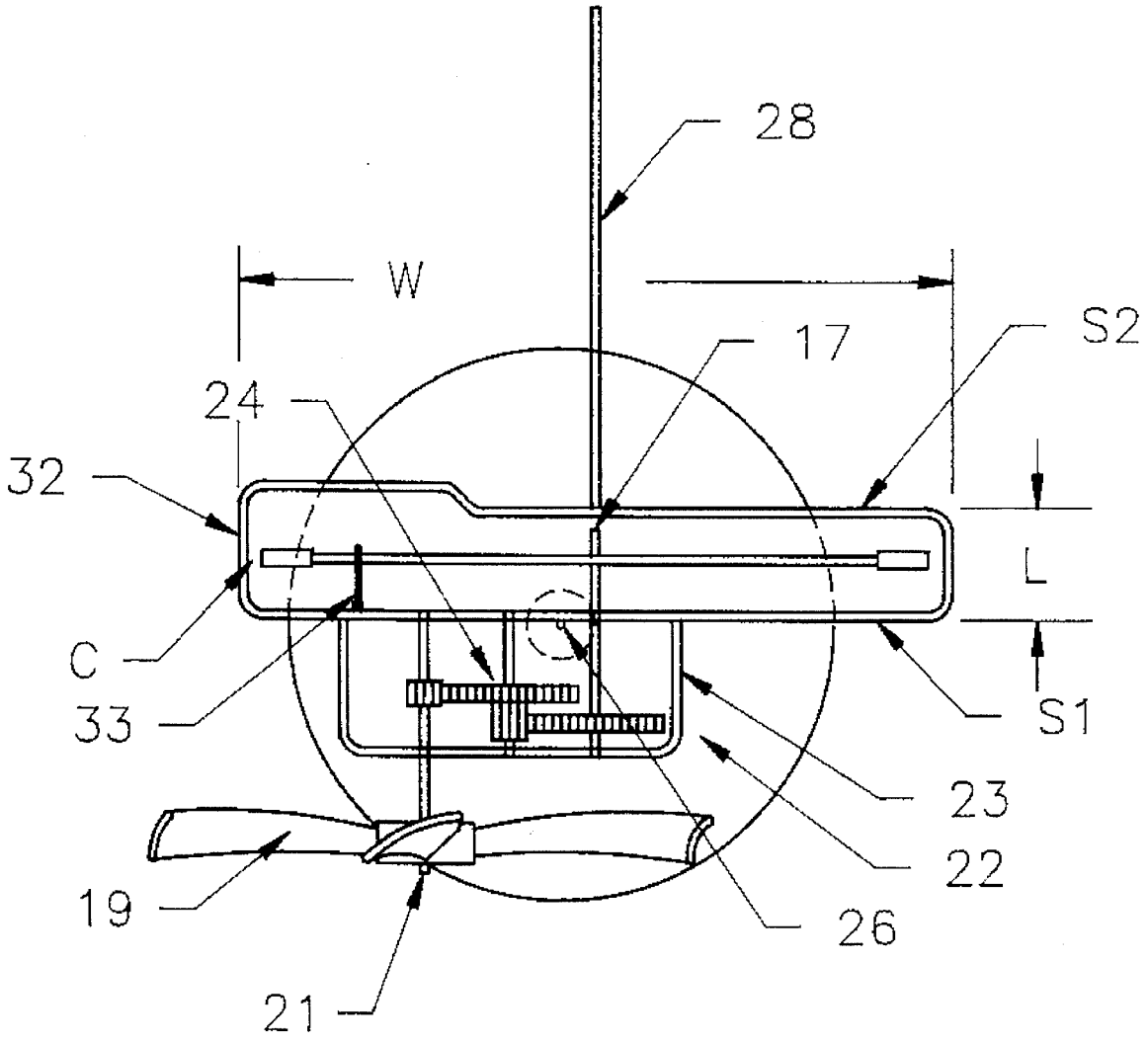
FIG. 2 is a top view of the apparatus of FIG. 1.

In order to introduce a soapy solution to the rings 14, a suitable container or reservoir such as 32 is needed so that the rings 14 will be brought into contact with the solution but the fan blades 19 are not. The device of the present invention comprised solely of the wand assembly 12, the fan assembly 18 and the gear box 22 could be suspended over a large open container of soap solution such that the rings 14 engaged the solution and the blades 19 do not and in a wind the device would self-generate bubbles. For convenience it is desirable to provide the aforesaid assemblies with an attached reservoir 32 as shown in FIG. 1. This reservoir 32 can be half-moon shaped and be of a length L as shown in FIG. 2. The width W of the reservoir 32 is such that it is slightly greater than the combined length of the ring 14 and arm 15 so that there is adequate clearance C between the rings and the inside surface of the reservoir 32. The top view of the reservoir 32 in FIG. 2 shows it with a generally rectangular opening with a first long side S1 and a second long side S2. In this example of a preferred embodiment, the housing 23 of gear box assembly 22 is affixed to said the front of the reservoir 32 on long side S1 such that axle 17 extends over the top edge of the reservoir on long side S1 and the axle 21 and fan assembly 18 are to the front of and outside the reservoir 32. The use of one intermediate gear 24 will cause the wand assembly 12 to rotate in the same direction as the fan assembly 18. The blades are oriented to the incoming breeze such that the fan blades 19 will rotate in a clockwise manner when viewed from the front. Likewise the wand assembly 12 will rotate in a clockwise manner causing the rings 14 and arms 15 to emerge from the surface 25 of the soap solution in the area behind the fan assembly 18. The length of each fan blade and the offset of axle 21 of the fan assembly 18 is such that the rings 14 in the wand assembly 12 are behind the area being swept by the fan assembly 18 from approximately the nine o'clock position to about the eleven o'clock position so that the excess solution has sufficient opportunity to drip off back into the reservoir 32 and not be blown beyond side S2 and onto the ground or structures below. Because of the energy being taken out of the breeze by the fan assembly 18, the breeze in the area behind the fan assembly 18 is less forceful and allows the solution to form a coherent film over the opening of rings 14 and the excess material to drip back into the reservoir 32.

Ring 14' has reached a position that is vertically clear of the fan blades 19 and is now subject to the full forces of the ambient wind; bubble formation commences at this point and is usually completed well before the arm 15 reaches the horizontal or three o'clock position. At this point ring 14 passes downward into the reservoir 32 for reapplication of bubble forming solution when it is submerged below surface 25. As the bubbles are continuously generated the surface 25 recedes and needs to be replenished once it is no longer capable of covering ring 14 when it is in its lowest position.

Figure 3:
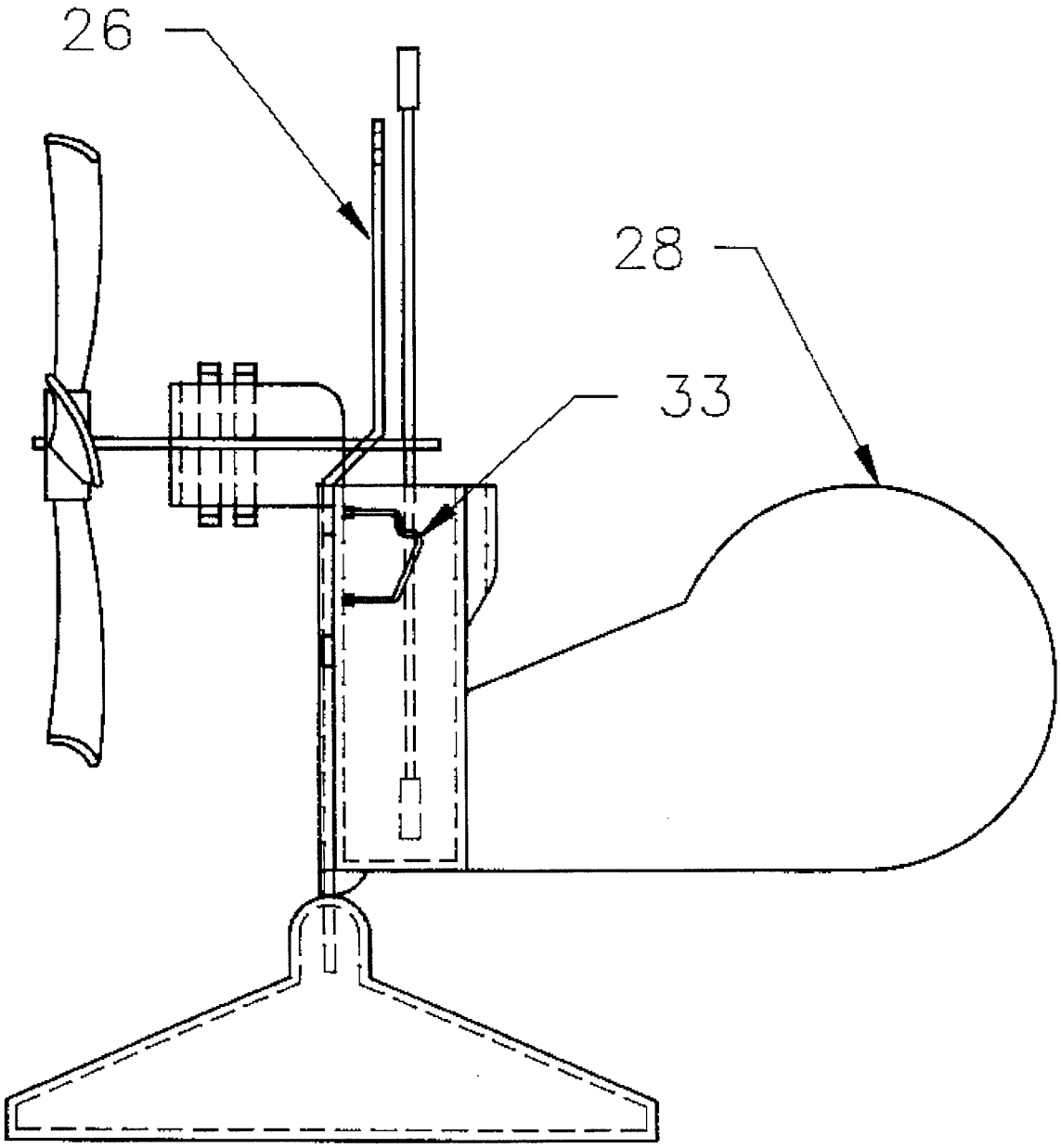
FIG. 3 is a side view of FIG. 1 of the bubble blowing apparatus of the present invention with a rudder to permit self orientation into the wind.

A convenient way to use the device of the present invention is to provide it with structural member 26 which is centrally affixed to the front of the reservoir 32 and behind the fan assembly 18 so as to be reasonably close to the center of gravity of the device. With the narrow structural member 26 extending vertically to above the ring 14 in its highest position and providing an eyelet 27 at the upper terminus of member 26, a string, wire or rope can be connected to the device to permit its suspension in a manner similar to a wind chime. In this configuration it is preferable to have a wind vane 28, as depicted in FIG. 3, so as to keep the blades of the fan assembly 18 and the rings 14 of the wand assembly 12 in proper orientation to the wind; in this manner the axles 17 and 21 both have their longitudinal axes in alignment with direction of the wind. The simplest approach is to simply affix the wind vane 28 to the rear of said reservoir 32 on the side S2 thereof.

The narrow structural member 26 can be extended downward so as to permit is engagement with stand 11. This engagement can be fixed whereby the unit can be pointed into the wind; or it can be inserted into stand 11 so as to permit it to swivel in stand 11 and, with a rudder 28 affixed thereto, the unit will point into the wind to automatically generate bubbles.

The structural member 26 should be sufficiently narrow that it does not interfere with the wind and affect the generation of bubbles as rings 14 pass behind it.

Although the reservoir 32 is shown to have a rectangular opening at the top, the geometry can be altered so as to accomplish the desired results. For example the distance L, as depicted in FIG. 2, can be narrower on the right side of the unit where the wands 13 are moving downward since there is little excess bubble solution at that stage that would blow past the rear side S2 and drop to the surfaces below the unit. The value for L on the left side of the apparatus needs to be sufficient to allow the excess bubble solution to drip back into the reservoir 32 and not be blown past side S2 and onto the surfaces below. To further conserve bubble forming solution, the present invention can be provided with a member 33 as shown in FIG. 3 to flick excess solution off the wands 13. The wands are flexible and will bend slight. When a wand rotates past member 33, the wand 13 will ride up the incline portion of said member 33 and be bent slightly to the rear; then when wand 13 proceeds past the incline, it will snap quickly back to its original unbent condition causing excess solution to leave the wand and fall back into the reservoir 32.

A wide number of variations on the basic design of this invention will suggest themselves to those skilled in the art. For example a mirror image arrangement of the wand assembly 12, fan assembly 18 and interconnecting gear box may be used so that the fan assembly 18 is on the right side of the unit and the fan assembly 18 and wand assembly 12 rotate in a counterclockwise direction. Moreover the number of fan blades 19 or wands 13 may be varied from that depicted in FIG. 1 without having an effect on the functional aspects of the apparatus.

Having thus described the invention, a number of variations on the basic design described above will occur to those skilled in the art without departing from the spirit or scope of the claims below.

I claim:

1. An bubble blowing apparatus suitable for generating a multitude of bubbles comprising:

a. a wand assembly containing a plurality of wands having arms of predetermined length having an opening at a first end of each of said arms and a second end affixed in radial fashion to a hub and first axle causing such wand assembly to generate a circle of a predetermined diameter;

b. an air-flow-driven, fan assembly comprised of a plurality of fan blades of substantially the same predetermined length radially affixed to a hub and a second axle; and c. means for mechanically interconnecting the fan assembly to the wand assembly so that when air flow occurs across said fan blades causing it to rotate about the second axle, the wand assembly is caused to rotate about the first axle at a predetermined rate;

d. an open-topped reservoir is provided for containing a bubble-making liquid which reservoir is physically affixed to and located below the first axle of said wand assembly so that each of said openings at the first end of each of said arms is below the open-top of said reservoir at some time during rotation about the first axle wherein the open top of said reservoir is generally rectangular with first and second long sides thereof having generally the same elevation and said sides being of a predetermined length which length is greater than the predetermined diameter of said circle generated by the wand assembly;

e. the wand assembly being positioned with respect to the fan assembly such that when each wand opening prior to its point of highest elevation is behind the area being swept by the fan blades;

f. the fan assembly and the means for mechanically interconnecting the fan assembly to the wand assembly being affixed to and outside of the first long side of the reservoir wherein the distance between the first axle of the wand assembly and the second axle in the fan assembly is less than one-half the predetermined diameter of said circle generated by the wand assembly and the wands rotate such that they emerge from the top of the first long side of the reservoir behind the area being swept by the fan assembly whereby the opening of each wand is no longer behind the area being swept by the fan assembly when the wand opening is at a point of highest elevation.

2. A bubble blowing apparatus as in claim 1 wherein the open topped reservoir and the bubble blowing apparatus are physically affixed to a narrow, vertically-extending structural-element having an upper terminus above said wands at their greatest elevation and a lower terminus lower than the lowest portion of the reservoir.

3. A bubble blowing apparatus as in claim 2 wherein the upper terminus of said structural-element is affixed to a rope or wire for overhead suspension and a fixed rudder extending at right angles to and outside of said second long side of said reservoir, said rudder having sufficient surface area such that when the apparatus is suspended and subjected to the flow of air, the first and second axles are caused to be axially aligned with the air flow.

4. A bubble blowing apparatus as in claim 2 wherein the lower terminus of the structural-element is connected to a stand assembly for supporting the bubble blowing apparatus on a surface below the bubble blowing apparatus.

5. A bubble blowing apparatus as in claim 4 wherein the bubble blowing apparatus can freely rotate relative to the stand assembly and the bubble blowing apparatus is provided with a rudder of sufficient area such that when subjected to the flow of air the first and second axles are caused to be axially aligned with the air flow.

* * * * *